United States Patent [19]

Sole et al.

[11] Patent Number: 4,921,436

[45] Date of Patent: May 1, 1990

[54] MODULAR JACK ASSEMBLY

[75] Inventors: Xavier C. Sole, Premia De Mar; Luis B. Roses, Mataro, both of Spain

[73] Assignee: AMP Incorporated, Harrisburg, Pa.

[21] Appl. No.: 360,961

[22] Filed: Jun. 2, 1989

[30] Foreign Application Priority Data

Aug. 9, 1988 [ES] Spain ..... 8802492

[51] Int. Cl.[5] ..... H01R 4/24

[52] U.S. Cl. ..... 439/395; 439/736; 439/417

[58] Field of Search ..... 439/586, 587, 592, 593, 439/595, 597, 736, 741, 751, 395–419

[56] References Cited

U.S. PATENT DOCUMENTS

H1 12/1985 Wattana-Chayakul ..... 439/396
3,487,350 12/1969 Hammell ..... 439/595
3,855,567 12/1974 Harms et al. ..... 439/593
4,261,633 4/1981 Abernethy .

FOREIGN PATENT DOCUMENTS 2083958 3/1982 United Kingdom .

*Primary Examiner*—David Pirlot
*Attorney, Agent, or Firm*—William B. Noll

[57] ABSTRACT

A jack type electrical connector, preferably for use in a telephone wiring system, comprising an insulative base module having embedded therein a plurality of elongated metal spring contacts. Each such contact includes a recess, aligned with a through hole in said base module, which is elastically expanded upon insertion therein of a barrel type terminal to exert a retention force on said barrel type terminal while electrically connecting said barrel type terminal to said metal circuits.

4 Claims, 3 Drawing Sheets

MODULAR JACK ASSEMBLY

BACKGROUND OF THE INVENTION

The present invention relates to a jack type electrical connector, particularly for use with a universal telephone jack. An important advantage of this invention is its ease of assembly and the ability to effectively retrofit existing telephone wiring systems with replacement jacks.

An existing wiring module for a telephone jack is disclosed in U.S. Pat. No. 4,261,633. A component thereof is a molded dielectric base, a plurality of metal strip circuits and a like plurality of free standing terminals electrically connected to said circuits. Each strip of the circuit includes a narrow neck portion. The free standing terminals are provided with a slotted plate portion, which, when inserted into the molded dielectric base, engages such narrow neck portion to thereby bring such terminals into electrical contact with its strip circuit.

SUMMARY OF THE INVENTION

The present invention represents a modular jack assembly which is simple in construction and easy to install in existing communication systems. More particularly, this invention is directed to a jack type electrical connector comprising an insulative base module having embedded therein a plurality of elongated metal spring contacts. Each such contact includes a recess or aperture, aligned with a through hole in said base module, which is elastically expanded upon insertion therein of a barrel type terminal to exert a retention force on said barrel type terminal while electrically connecting said barrel type terminal to said metal circuits.

DETAILED DESCRIPTION OF PREFERRED EMBODIMENT

Figure 1:
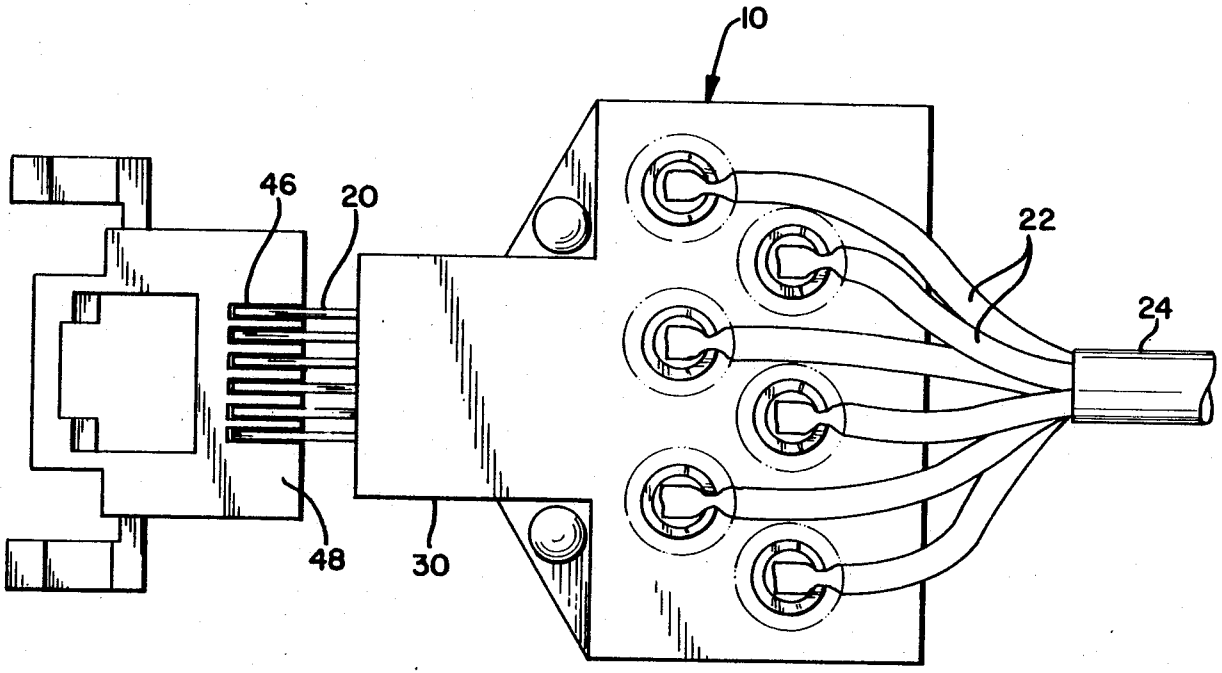
FIG. 1 is a plan view of an exemplary telephone communication system utilizing the electrical connector assembly of this invention.
Figure 2:
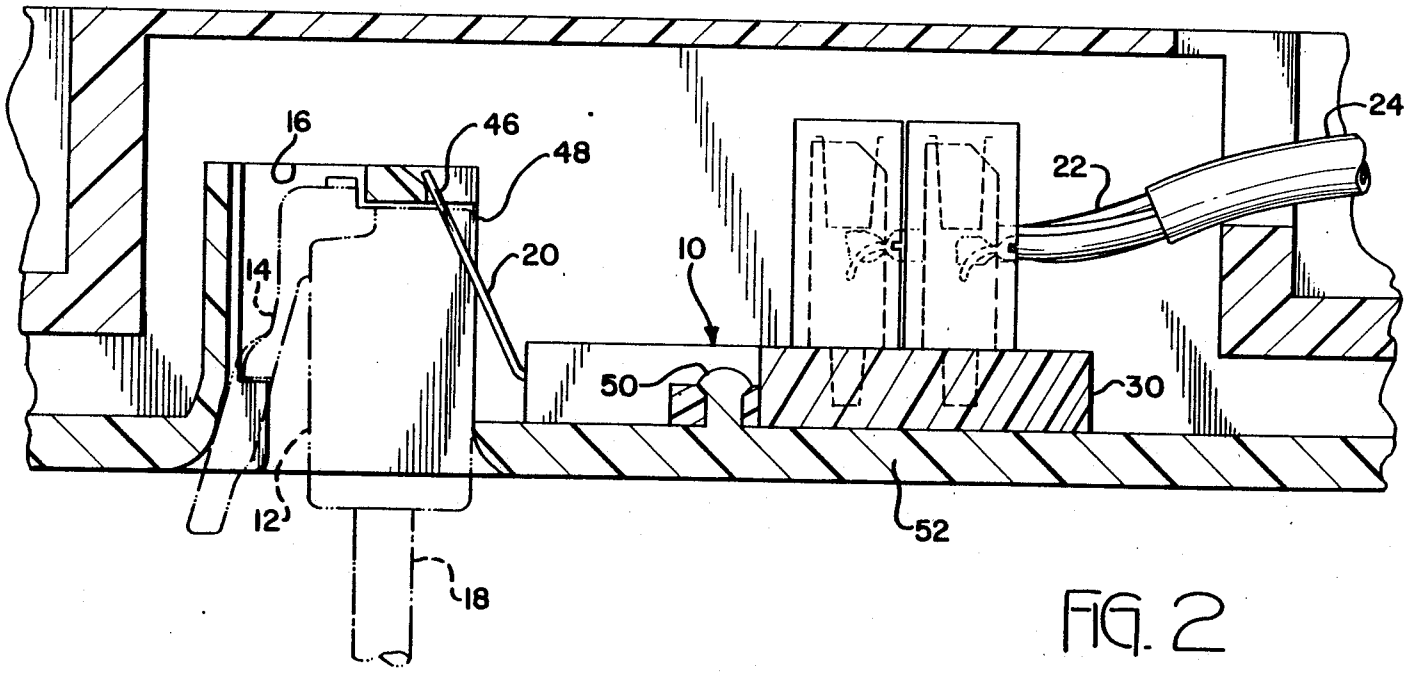
FIG. 2 is a side view of the system shown in FIG. 1.

In FIGS. 1 and 2 there is illustrated the several components which typically comprises a telephone wiring system, and which includes the electrical connector assembly 10 of this invention.

Before describing such assembly, an overview of the system may be helpful. The phantom outline, see FIG. 2, shows an electrical plug 12 with latch 14 to secure same within the cavity 16. In a manner well known, and therefore, not shown, wires from cable 18 engage corresponding electrical contact leads 20, thereby establishing electrical connection of the cable 18 to the contacts 20. The electrical circuitry is completed by connecting insulated wires 22 of cable 24 to the upstanding terminals.

Figure 4:
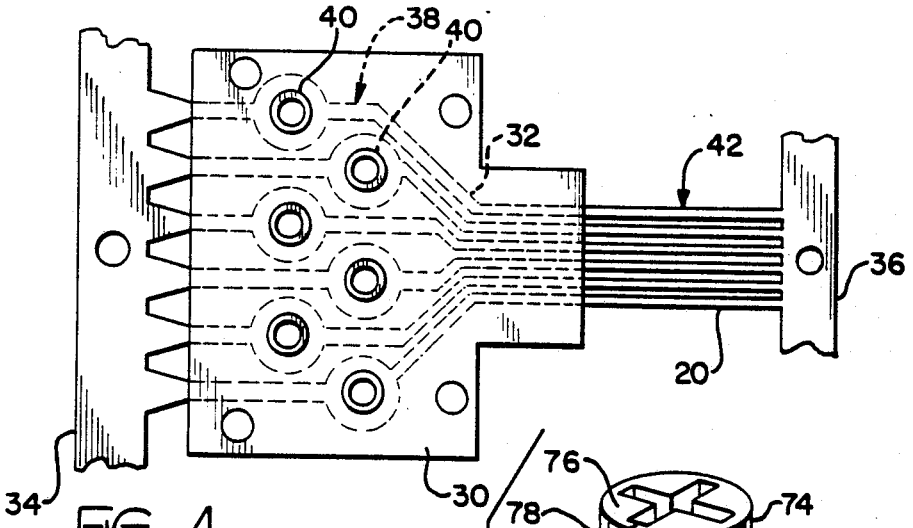
FIG. 4 is a plan view of the subassembly shown in FIG. 3, except that carrier strips, at either end thereof, are shown attached to the circuit strip.
Figure 3:
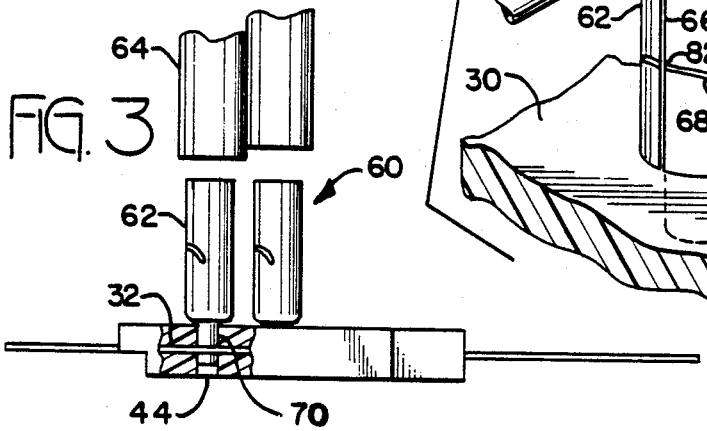
FIG. 3 is a side view of the electrical connector assembly illustrating the relationship between the barrel type terminal and circuit strip according to one feature of this invention.

The electrical connector assembly 10 of this invention comprises a modular base 30, formed of a rigid dielectric material within which there is embedded a plurality of elongated metal spring contacts 32, as best seen in FIGS. 3 and 4. The elongated metal spring contacts 32, formed between a pair of metal carrier strips 34 and 36, are typically stamped and formed from a single strip of electrically conductive metal. It should be noted that only a single carrier may be used without loss of technical performance or ease of assembly. In any case, the contacts 32 include relatively widely spaced lead portions 38, each having a generally circular recess or aperture 40. Adjacent recesses 40 are usually staggered to give adequate room in a minimum of area.

At the opposite end 42 of the contacts 32, the contact leads 20 are closely packed, and, in a manner to be described later, project outside the modular base 30.

The base 30 is molded over the contacts 32, such that the contacts 32 are embedded therein, in the manner best illustrated in FIG. 3. The base 30 is molded with through openings or holes 44, one aligned with each recess 40. To prepare the assembly for use in a telephone system, by way of example, the carrier strips 34 and 36, if both are present, are removed by procedures shown in the art. The contact leads 20, which project from the base 30, are bent at an angle, as best seen in FIG. 2, to provide cantilever beams, the ends 46 of which typically lie in slots provided in the wall 48 of cavity 16.

The base 30 is typically provided with means 50 to secure the base to a frame support 52, the structure or housing within which cavity 16 is provided for receiving electrical plug 12.

Figure 5:
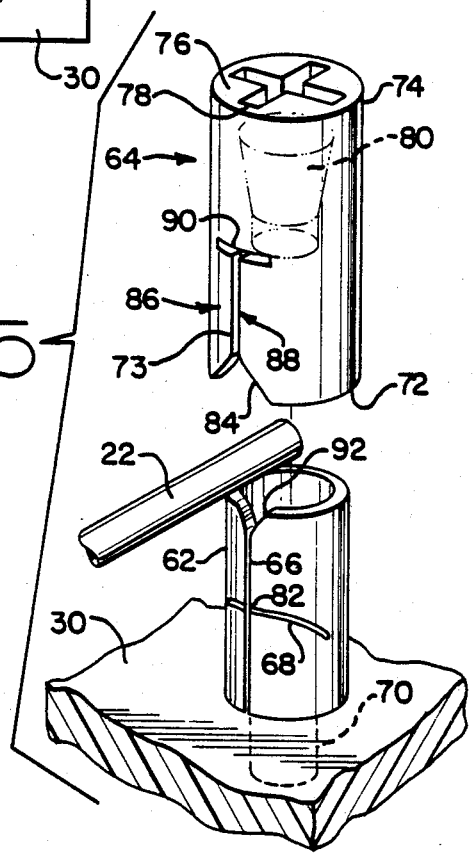
FIG. 5 is an exploded perspective view of an exemplary barrel type terminal for use in the assembly hereof.

In FIGS. 3 and 5 there is illustrated an insulation covered wire, slotted barrel type terminal assembly 60 of the kind contemplated by this invention. Such terminal 60 comprises terminal portion 62 and cover 64 which serves to insert wire into terminal portion 62. The terminal portion 62 is generally cylindrical in configuration, having a longitudinal slot 66 and a transverse slot 68 into which a wire 22 is inserted. At the base thereof, the terminal portion 62 includes a reduced section 70 which, as indicated above, is inserted into openings 44 and recesses 40, thereby establishing electrical contact with contacts 32. The sizing of such reduced section 70 is slightly larger than the recesses 40 so that said recess will be elastically expanded upon the insertion of such reduced section 70.

In securing the terminal portion 62 to the base 30, the reduced portion 70 is seated into the appropriate opening 44 adjacent its respective circuit recesses 40. Such terminal is then urged further toward and through such recess 40, whereby the recess or aperture 40 is elastically expanded to securely hold the terminal portion 62.

The other major component, the cover 64, is generally of cylindrical sleeve configuration and is typically molded in one piece, or plural pieces if desired, from a dielectric material. The cover 64 includes an open end 72 having slot 73 cut therefrom, and a closed end 74 defined by end wall 76. To permit rotation of cover 64, end wall 76 is provided with a tool receiving recess 78. An inwardly projecting, generally frustoconical shaped wire stuffer 80, shown in phanton in FIG. 5, is provided to force wire 22 into longitudinal slot 66 and down to the intersection 82 with transverse slot 68.

During assembly of the cover 64 over the terminal 62, together with the insertion of an insulated wire 22 from cable 24, the cover is shown in FIG. 5 as having a flared entryway 84 overriding wire 22. As the cover 64 is progressively received concentrically over the terminal 62, the wire 22 is gripped by flaps 86 and 88 on either side of slot 73 which has received wire 22 therein. The transverse slot 90 provides a positive stop for wire 22 and allows flaps 86 and 88 to grip the wire moving radially without deforming the cover 64. At this stage the terminal assembly 60 is partially assembled with wire 22 in registration with flared entryway 92 of slot 66. As the cover 64 is brought into a closed telescopic relationship with terminal 62, the stuffer 80 moves wire 22 progressively down slot 66 to transverse slot 68. The wire 22 is held in position by the stuffer 80 and the slot 90. The flap portions 86 and 88 resiliently grip the wire 22 across the cross section thereof to provide a strain relief and to prevent pull out or breakage of the wire where gripped by the terminal 62. The wire 22 is prevented from traversing further along the slot 66 and past the transverse slot 68 because the top portion of the terminal will radially expand as compared with the bottom portion of the terminal 62. The presence of the transverse slot 68 thereby allows independent radial expansion of the top and bottom portions of the terminal.

To assist in the final assembly of cover 64 to terminal 62, a common tool, such as a standard screwdriver, may be placed in recess 78 and the cover pushed down and turned.

With each said wire 22 so terminated to a corresponding terminal assembly 60, electrical contact is thereby established between cable 24 and contact leads 20, the latter being disposed for electrical contact with plug 12.

We claim:

1. A jack type electrical connector adapted for splicing wires for a communication system, comprising an insulative base modular, a plurality of through holes, a like plurality of terminal receiving means in communication with said base module, a plurality of metal circuits within aid base module, where each said metal circuit has a free end projecting from one side thereof for resilient engagement with electrical contacts of a plug type electrical connector terminated electrically to said communication system, wherein said metal circuits comprise a plurality of elongated metal spring contacts where each said contact includes an aperture in registry with one of said holes for receiving a terminal receiving means, said aperture being elastically expanded upon insertion therein of a terminal receiving means to exert a retention force thereon while electrically connecting said terminal receiving means to said metal circuits.

2. The jack type electrical connector according to claim 1, wherein said terminal receiving means comprises a barrel terminal having an insulation displacement slot therein for terminating a wire.

3. The jack type electrical connector according to claim 1, wherein said insulated base module comprises a rigid elastomeric material within which said metal circuits are embedded.

4. The jack type electrical connector according to claim 3, wherein said insulated base module is secured to a plate member which includes a plug receiving cavity into which said free ends project.

* * * * *

UNITED STATES PATENT AND TRADEMARK OFFICE

CERTIFICATE OF CORRECTION

PATENT NO. : 4,921,436

DATED : May 1, 1990

INVENTOR(S) : Xavier C. Sole, Luis B. Roses

It is certified that error appears in the above-identified patent and that said Letters Patent is hereby corrected as shown below:

In claim 1, column 4, line 6, the word "aid" should be changed to --said--.

Signed and Sealed this

Eighteenth Day of February, 1992

*Attest:*

HARRY F. MANBECK, JR.

*Attesting Officer*

*Commissioner of Patents and Trademarks*